US009079086B2

(12) United States Patent
Craig

(10) Patent No.: US 9,079,086 B2
(45) Date of Patent: Jul. 14, 2015

(54) SYSTEM FOR INCREASING A BASKETBALL PLAYER'S SHOOTING ACCURACY

(71) Applicant: Rometra Craig, Portola Valley, CA (US)

(72) Inventor: Rometra Craig, Portola Valley, CA (US)

( * ) Notice: Subject to any disclaimer, the term of this patent is extended or adjusted under 35 U.S.C. 154(b) by 22 days.

(21) Appl. No.: 13/655,977

(22) Filed: Oct. 19, 2012

(65) Prior Publication Data

US 2014/0113753 A1 Apr. 24, 2014

(51) Int. Cl.

| | |
|---|---|
| ***A63B 69/00*** | (2006.01) |
| ***A63B 21/06*** | (2006.01) |
| ***A63B 21/00*** | (2006.01) |

(52) U.S. Cl.

CPC ..... *A63B 69/0071* (2013.01); *A63B 21/06* (2013.01); *A63B 21/1415* (2013.01); *A63B 69/0059* (2013.01); *A63B 2069/0062* (2013.01); *A63B 2209/02* (2013.01); *A63B 2225/09* (2013.01)

(58) Field of Classification Search

CPC ..... A63B 21/015
USPC ..... 473/450, 458, 464, 472, 479
See application file for complete search history.

(56) References Cited

U.S. PATENT DOCUMENTS

| | | | | |
|---|---|---|---|---|
| 3,820,783 | A * | 6/1974 | Caveness | 473/450 |
| 4,383,685 | A * | 5/1983 | Bishop | 473/450 |
| 4,718,665 | A * | 1/1988 | Airy et al. | 482/119 |
| 5,544,877 | A * | 8/1996 | Brownell | 473/450 |
| 5,769,743 | A * | 6/1998 | Stephan et al. | 473/450 |
| 5,816,952 | A * | 10/1998 | Blevins | 473/450 |
| 5,865,695 | A * | 2/1999 | Mahala et al. | 473/450 |
| 8,157,666 | B2 * | 4/2012 | Schutte | 473/215 |
| 8,292,760 | B2 * | 10/2012 | Johnson | 473/450 |
| 2011/0015003 | A1 * | 1/2011 | Johnson | 473/453 |
| 2011/0111890 | A1 * | 5/2011 | Webb et al. | 473/458 |
| 2012/0142416 | A1 * | 6/2012 | Joutras | 463/36 |
| 2014/0113753 | A1 * | 4/2014 | Craig | 473/450 |

* cited by examiner

*Primary Examiner* — Mitra Aryanpour
(74) *Attorney, Agent, or Firm* — Buchanan Ingersoll & Rooney PC

(57) ABSTRACT

An assembly for increasing a basketball player's shooting accuracy, which includes a hinge assembly, a lower arm support, and an upper arm support. The hinge assembly has a plunger, which is configured to extend outward from the hinge assembly, and has proximal end having an opening, which is configured to be attachable to one or more cords and wherein upon raising of the player's elbow to approximately shoulder height, the plunger releases from within a hinge pin within the hinge assembly to allow the lower arm support and the upper arm support to move relative to one another.

6 Claims, 12 Drawing Sheets

SYSTEM FOR INCREASING A BASKETBALL PLAYER'S SHOOTING ACCURACY

FIELD OF THE INVENTION

This invention relates to a method and system for sports training, and more particularly to a method and system for increasing a basketball player's shooting accuracy by reinforcing a players' shooting position.

BACKGROUND

Basketball players, both young and experienced alike often use incorrect shooting form by exhibiting poor mechanics in shooting a basketball. These habits can lead to poor shooting accuracy in making baskets consistently.

One way to improve shooting accuracy is through the use of repetitive drills, which help players develop the muscular motions and hand or foot and eye coordination necessary for proper actions in that sport. Accordingly, various teaching aids have been developed for assisting a player to develop the necessary skills. Most such teaching aids can only be used while practicing and cannot be used when actually playing the sport.

Various techniques are used in shooting a basketball which improves the ability of the player to get the ball successfully in the basket. The position of the shooting hand and arm are important in the process. Poor positioning of the arm and hand can result in poor performance. A major problem in training young basketball players is that they develop poor shooting techniques which thereafter become habitual and are difficult to correct as the players' shooting skills develop. For example, a player who develops improper shooting habits has greater difficulty learning proper techniques which can improve his or her game. The novice tends not to be aware of proper arm and elbow placement, before, during and after the shot. Thus, they fail to properly align the arm, wrist, hand, and basket as necessary for a proper shot. Accordingly, it would be desirable to have a method and system for increasing a basketball player's shooting accuracy by reinforcing a players' shooting position.

SUMMARY OF THE INVENTION

In consideration of the above issues, it would be desirable to have a system and method, which reinforces a player's shooting position.

In accordance with an embodiment, an assembly for increasing a basketball player's shooting accuracy, comprises: a hinge assembly; a lower arm support; an upper arm support; and wherein the hinge assembly has a plunger, which is configured to extend outward from the hinge assembly, the plunger having a proximal end having an opening, which is configured to be attachable to one or more cords and wherein upon raising of the player's elbow to approximately shoulder height, the plunger releases from within a hinge pin within the hinge assembly to allow the lower arm support and the upper arm support to move relative to one another.

In accordance with another embodiment, a system for increasing a basketball player's shooting accuracy comprises: a mechanical assembly having a lower arm support, an upper arm support, and a hinge assembly, which connects the upper arm support to the lower arm support, the hinge assembly having a locked position and an unlocked position; an elastic sleeve, which is configured to receive the mechanical assembly; and at least one cord, which is attached to the hinge assembly and provides a means for releasing the hinge assembly from the locked position upon raising of the player's elbow to approximately shoulder height.

In accordance with a further embodiment, a method for increasing a basketball player's shooting accuracy, comprises: providing a shooting apparatus, which includes a hinge assembly, a lower arm support, and an upper arm support; controlling a motion of a player's shooting motion with the shooting apparatus; and releasing the hinge assembly of the shooting apparatus upon raising of the player's elbow to approximately shoulder height, which allows the lower arm support and the upper arm support to move relative to one another.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
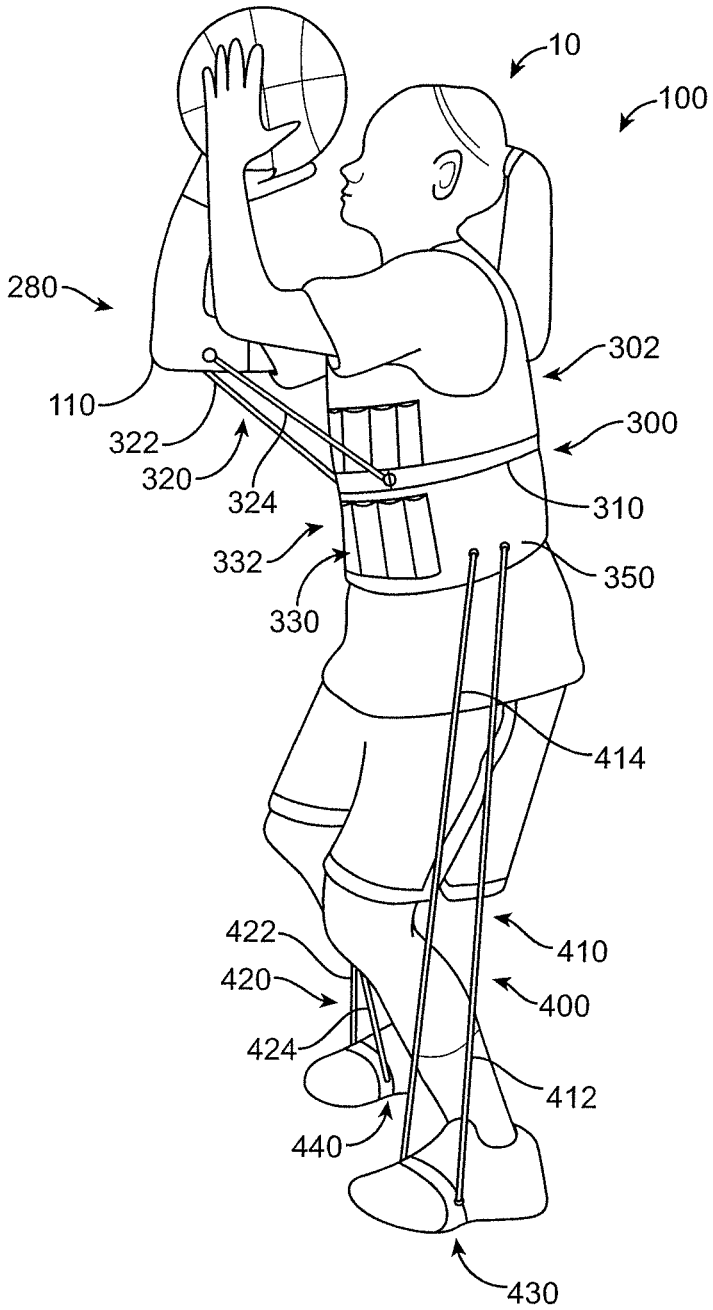
FIG. 1 is an illustration a system for increasing a basketball player's shooting accuracy in accordance with an exemplary embodiment.

Reference will now be made in detail to the embodiments of the invention, examples of which are illustrated in the accompanying drawings. Wherever possible, the same reference numbers are used in the drawings and the description to refer to the same or like parts.

In accordance with an exemplary embodiment, it would be desirable to increase a player's shooting accuracy by reinforcing a proper shooting technique by incorporating a mechanical assembly 200 into a unique sleeve design 280 that increases development of muscle memory by preventing the player (after drawing the ball to their body) from extending beyond a desired 90 degree angle shooting posture until the player's elbow rises to shoulder height. The mechanical assembly 200 includes a hinge system 210, which allows the player to reload and repeat through regular ball handling during both practice and game like situations.

Most basketball players (young and experienced alike) use incorrect shooting form and do not exhibit the proper mechanics when shooting a basketball, which leads to poor shooting accuracy in making basketball consistently. The mechanical assembly 200 with its unique sleeve design 280 reinforces correct shooting motion (action). The system 100 is easy to put on and adjust to ensure a correct fit. The system 100 also increases development of muscle memory by allowing the player to receive a pass normally (with outstretched arms, draw the ball into the chest, and forcing the player to raise their shooting elbow to shoulder height before allowing him/her to shoot the ball. The unique hinge system 210 allows players to use the system 100 during regular drills with full range of motion. When the shooting system is engaged by drawing the ball into the chest, the system 100 prevents the player from shooting the basketball until the shooting elbow rises to shoulder height. The shooting motion resets the elbow mechanism allowing free movement of the shooting arms. Unlike any other device, the system allows the elbow to continue to bend less than 90 degrees (to "load" the arm for a shot) while still preventing full extension until the elbow is in the proper position. In addition, the system 100 can also promote strong dribbling skills of the player through the use of the system 100 as disclosed herein.

In accordance with an embodiment, the system 100 includes an adjustable strap or vest system 300, a shooting apparatus 110 having a sleeve 280 and a mechanical assembly 200, and a plurality of cords 320, 410, which connect to the adjustable strap or vest system 300, which are adjustable and act as a trigger mechanism for releasing a spring loaded plunger within the mechanical assembly 200. The mechanical assembly 200 can prevent the shooter from extending beyond the proper 90 degree angle until the shooting elbow rises to shoulder height.

FIG. 1 is an illustration a system 100 for increasing a basketball player's shooting accuracy in accordance with an embodiment. As shown in FIG. 1, the system 100 includes a shooting apparatus 110 having a mechanical assembly 200, an adjustable chest assembly or vest 300, and an adjustable cord system 400. The shooting apparatus 110 can be used on either a player's right or left arm without modifications.

The shooting apparatus 110 can include a sleeve 280 or other suitable mechanism to secure the mechanical assembly 200 to an outer portion of the forearm (between the wrist and elbow) and outer portion of the upper arm (between the elbow and armpit). For example, the sleeve 280 can be an elastic material, which compress around the shooter arm, one or more straps, and the like.

The shooting apparatus 200 is attached to the chest assembly 300 via one or more elastic cords 320. For example, as shown in FIG. 1, the one or more elastic cords 320 can include a pair of elastic cords 322, 324, which are attached to a proximal end of a plunger 260 (FIG. 3), which releases the hinge mechanism of the shooting apparatus 110 upon raising the shooter's elbow to shoulder height (or approximately 90 degrees). For example, the one or more elastic cords 322, 324 can be bungee or bungee-like cords.

The adjustable chest assembly 300 can include a vest 310, which is configured to fit over the shoulders of the user 10 and includes at least one strap 310, which is configured to be attached or secured around the user's chest and back and which also secures one end of the one or more elastic cords 320 to the user's chest and the other end to the proximal end 262 of the plunger 260. As shown in FIG. 1, upon the user raising his or her elbow to at a minimum shoulder height, the elastic cords 320 attached to the proximal end 262 of the plunger 260 releases the plunger 260, which allows the user to raise the arm upward, for example, full extension for teaching the proper release of the ball from the users hand and fingers. In accordance with an embodiment, the plunger has an engaged or locked position, for example, upon bending the forearm relative the upper arm at an approximately 90 degree angle, which prevents the lower arm support 220 from moving relative to the upper arm support 230 until the arm is raised to an approximate shoulder height. Once the arm is raised to an approximate shoulder height, the plunger 260 releases to a non-engaged or unlocked position, in which the user can raise his arm upward to release the ball towards the basketball hoop in a shooting motion. The chest assembly or vest 300 can also include an optional chest weight system 330, which is secured to the chest of the user 10 to add additional resistance during activity.

The chest assembly or vest 300 can also include one or more side cords attachments portions 350, which are configured to receive one or more cords 400, which are attached to a pair of foot straps 430, 440. The foot straps 430, 440 are configured to fit around the users shoes, and are attached to a pair of cords 410, 420, respectively, to provide added resistance during use. The pair of cords 410, 420 can each include one or more cords 412, 414, 422, 424, which are attached to the chest assembly or vest 300.

Figure 2:
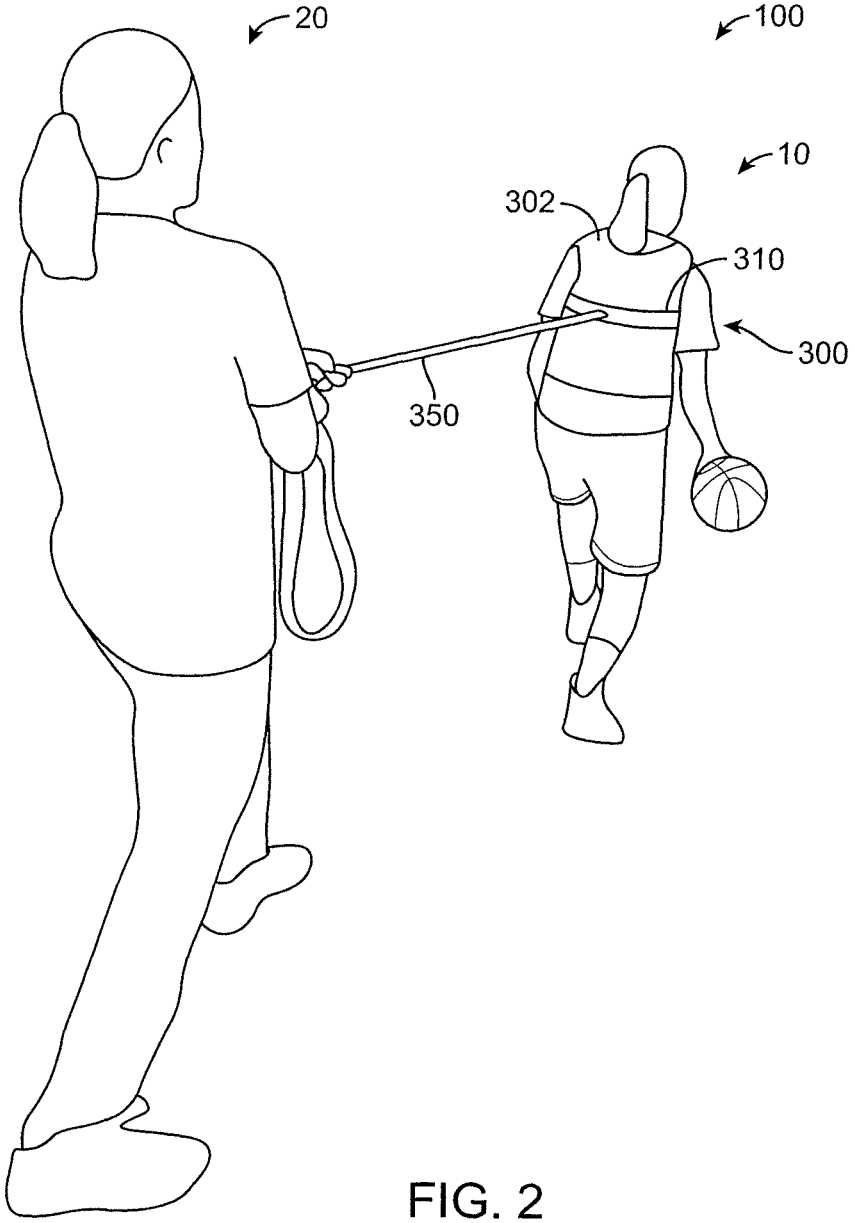
FIG. 2 is an illustration of a system for increasing a basketball player's shooting accuracy in accordance with another exemplary embodiment.

FIG. 2 is an illustration of a system 100 for increasing a basketball player's shooting accuracy in accordance with another embodiment. As shown in FIG. 2, the chest assembly or vest 300 can also be configured to receive a strap or cord 350, which is configured to be attached to a backside of the chest strap 310. The strap or cord 350 can be attached to or held by a second user 20 to provide added resistance to the user 10.

Figure 3:
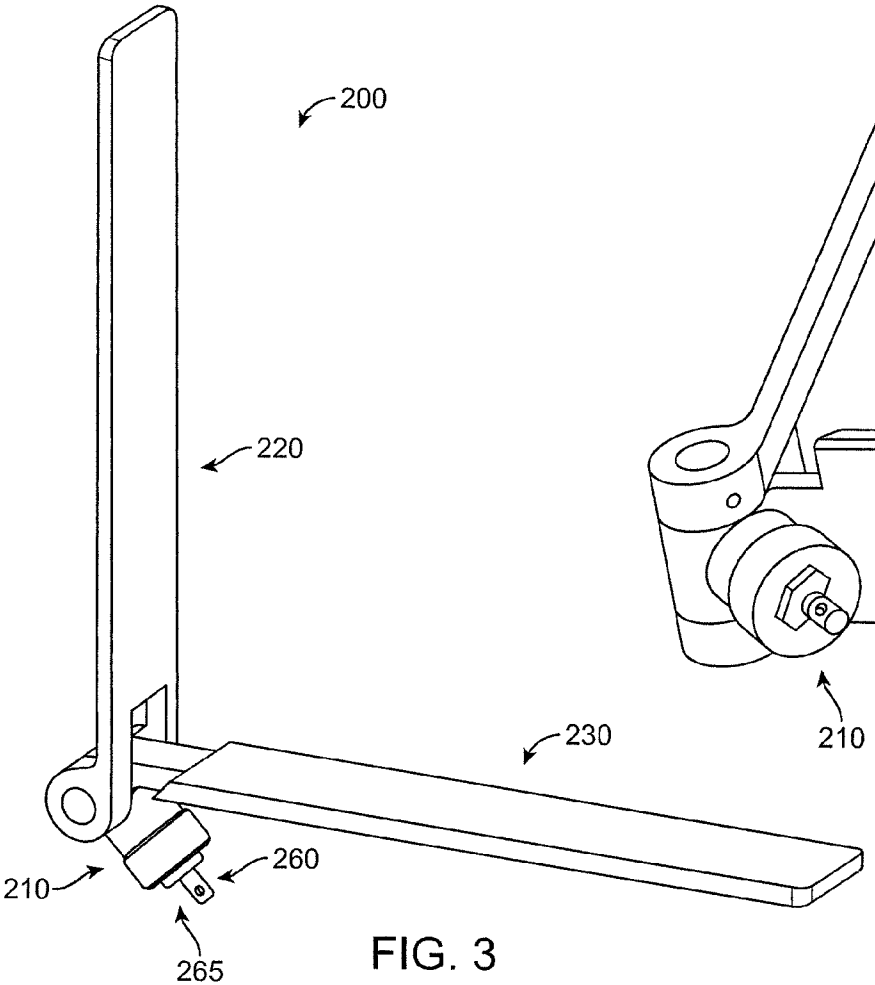
FIG. 3 is an illustration of a perspective view of a mechanical assembly for increasing a basketball player's shooting accuracy in accordance with an exemplary embodiment.

FIG. 3 is an illustration of a perspective view of a mechanical assembly 200 for increasing a basketball player's shooting accuracy in accordance with an embodiment. The mechanical assembly 200 includes a hinge assembly 210, a lower arm support 220, and an upper arm support 230. The hinge assembly 210 includes a plunger 260, which is configured to extend outer from the hinge assembly 210. The proximal end 262 of the plunger 260 includes an opening or portal 264, which is configured to be attachable to one or more cords and upon obtaining an at least 90 degree angle between the lower arm support 220 and the upper arm support 230, the plunger 260 releases the locking mechanism from within the hinge assembly 210 to allow the user 10 to raise their arm above his or her shoulders and release the ball in a desired shooting motion.

As shown in FIG. 3, the lower arm support 220 and upper arm support 230 have a generally elongated shape to match the lower arm (or forearm) and the upper arm (triceps' portion) of the user 10. The lower arm support 220 can be approximately 5 to 15 inches in length, and 1.0 to 3 in width, for example, 10 inches in length and 2 inches in width. In addition, the upper arm support 230 can be approximately 5 to 15 inches in length, and 1.0 to 3 in width, for example, 10 inches in length and 2 inches in width. The thickness of the lower arm support 220 and the upper arm support 230 can vary depending on the types of materials used for the mechanical assembly 200. For example, the mechanical assembly 200 can be a semi-rigid and/or rigid, and for example, can be made of plastic, wood, carbon fiber, and/or aluminum. In addition, in accordance with an embodiment, the length, width and thickness of the lower arm support 220 and the upper arm support 230 can be customized to fit each user's 10 specified body part. For example, the lower arm support 220 and the upper arm support 230 can have a curvature thereto to form fit around a user's forearm and/or upper arm.

Figure 4:
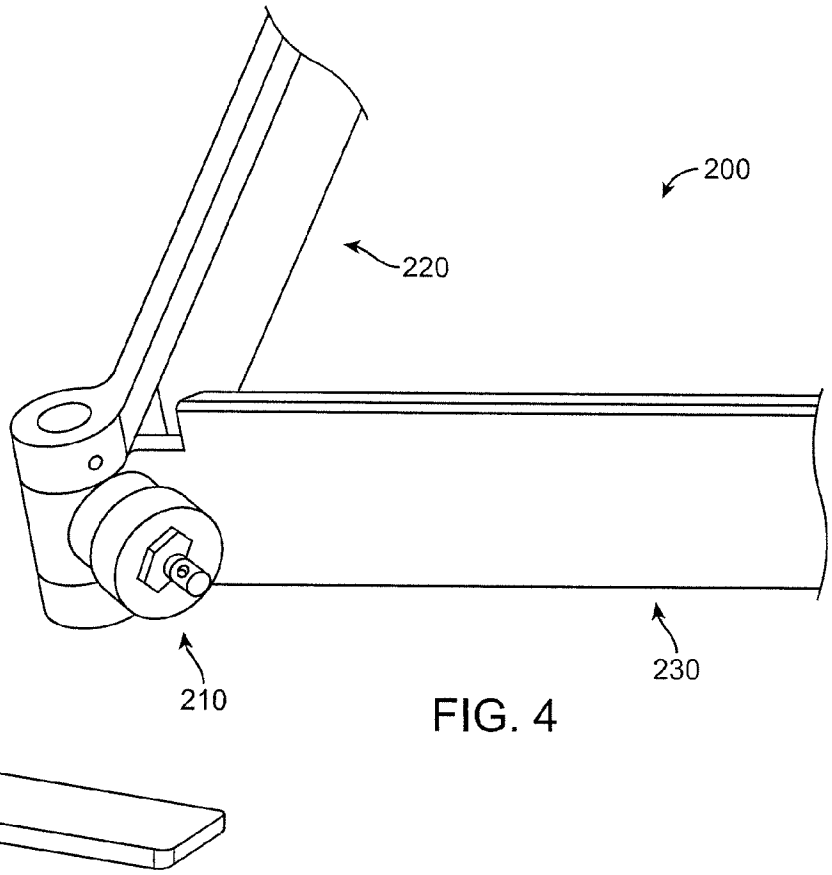
FIG. 4 is an illustration of another perspective view of the mechanical assembly for increasing a basketball player's shooting accuracy in accordance with an exemplary embodiment.

FIG. 4 is an illustration of another perspective view of the mechanical assembly 200 for increasing a basketball player's shooting accuracy in accordance with an embodiment. As shown in FIG. 4, the mechanical assembly 200 includes the hinge assembly 210 on a lower portion thereof, a lower arm support 220, and an upper arm support 230. As shown in FIG. 4, the hinge assembly 210 is configured to receive a proximal end 222 of the lower arm support 220 and a proximal end 232 of the upper arm support 230, which rotates from approximately an open horizontal position (e.g., 180 degrees) to a closed position (e.g., 0 degrees). As disclosed below, the relative positions of the forearm extend from 0 degrees when the lower arm support 220 is horizontal to the upper arm support 230 (e.g., 180 degrees to one another) to approximately 135 degrees upon bringing the forearm of the user or shooter 10 to his or her chest (e.g., 45 degrees).

Figure 5:
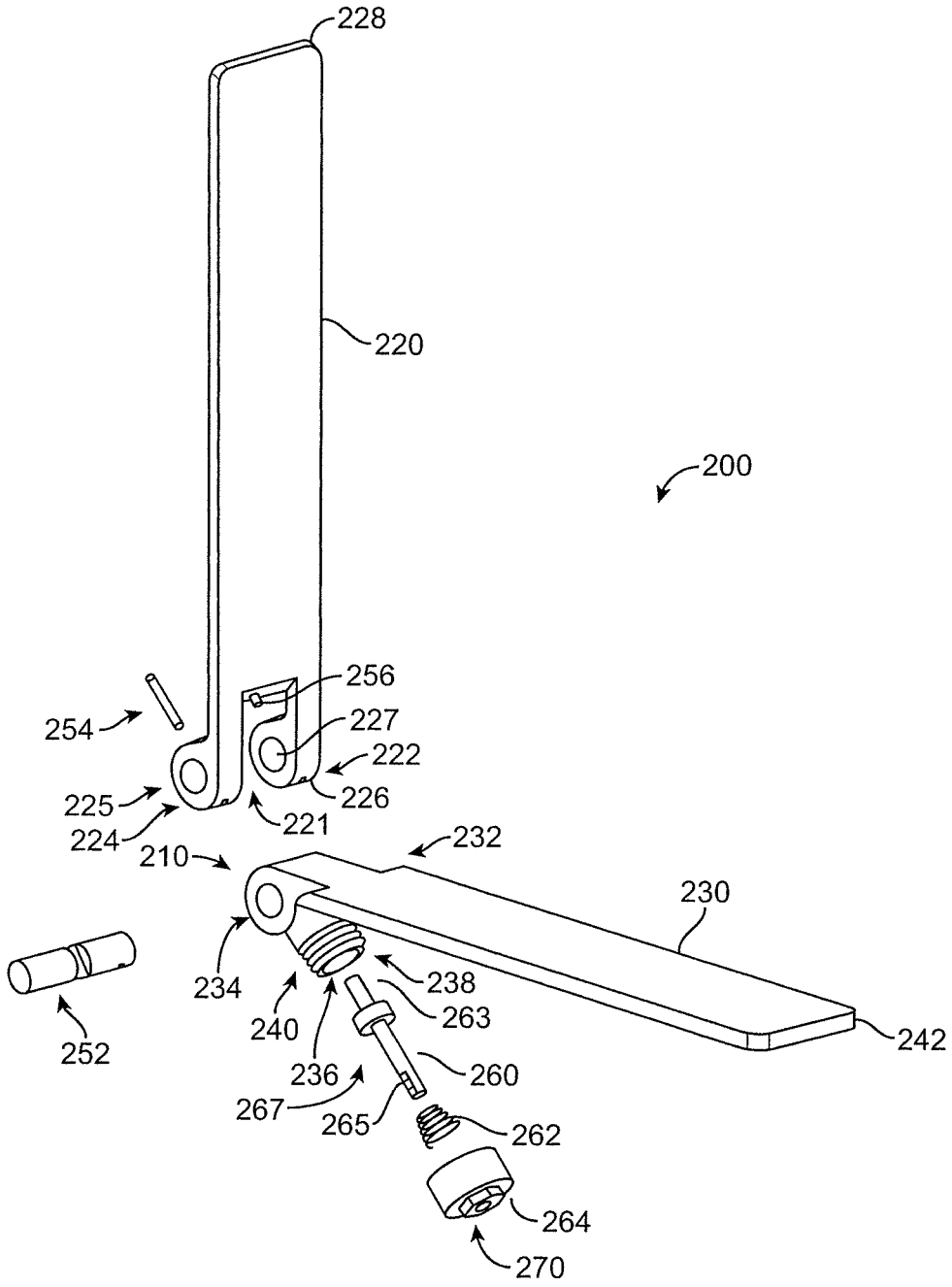
FIG. 5 is an illustration an exploded view of the mechanical assembly for increasing a basketball player's shooting as shown in FIGS. 3 and 4.

FIG. 5 is an illustration an exploded view of the mechanical assembly 200 for increasing a basketball player's shooting as shown in FIG. 4. As shown in FIG. 5, the hinge assembly 210 includes a hinge 252, a pair of hinge rods or set screws 254, 256, a plunger 260, a conical spring 270, and an end cap 264. The proximal end 222 of the lower arm support 220 has an open end 221 and a pair of arms 224, 226, each having a horizontal bore 225, 227 therein. The horizontal bores 225, 227 are configured to receive the hinge pin 252. Each arm 224, 226 includes a secondary bore 229, 231 (FIG. 6), respectively, which is perpendicular to and extends through the horizontal bores 225, 227, and is configured to receive one of the hinge rods 254, 256. The lower arm support 220 and the upper arm support 230 each have a free distal end 228, 242, respectively.

The proximal end 232 of the upper arm support 230 includes a cylindrical bore 234, which is configured to fit within the open end 221 of the lower arm support 220. The hinge pin 252 is configured to fit within the horizontal bores 225, 227 on the proximal end 222 of the lower arm support 220 and the cylindrical bore 234 on the proximal end 232 of the upper arm support 230. The proximal end 232 of the upper arm support 230 also includes a hinge or plunger bore 236, which extends perpendicular to the cylindrical bore 234. The hinge or plunger bore 236 is configured to receive the plunger 260 and the conical spring 262, which are secured to a threaded end 238 of an outer portion of the hinge/plunger bore 236, upon which is secured with an end cap 264.

Figure 6:
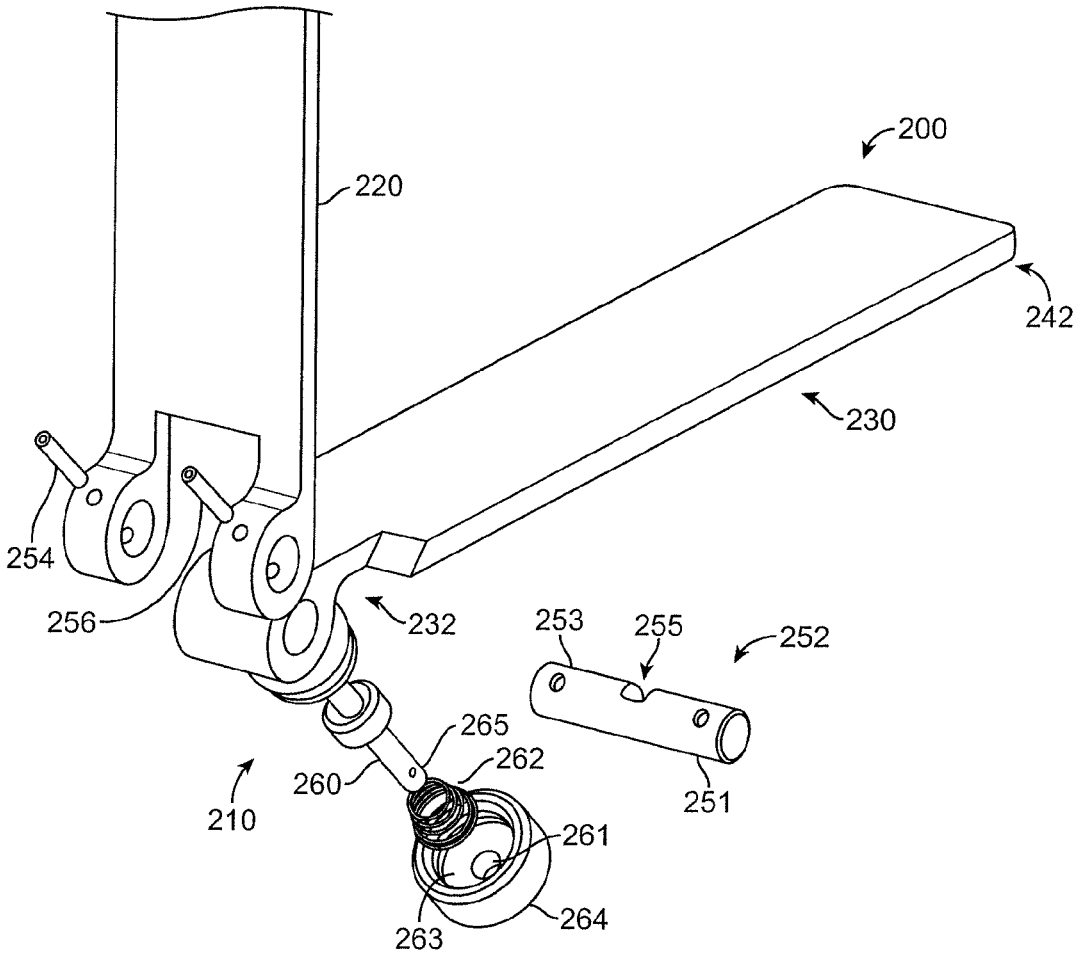
FIG. 6 is an illustration of another exploded view of the mechanical assembly for increasing a basketball player's shooting as shown in FIGS. 3 and 4.

FIG. 6 is an illustration of another exploded view of the mechanical assembly 200 for increasing a basketball player's shooting as shown in FIG. 4. As shown in FIG. 6, the hinge rods or set screws 254, 256 extend through a pair of bores 251, 253 through the pair of arms 224, 226 though an outer portion through a pair of bores 251, 253 within the hinge pin 252. The hinge pin 252 is a cylindrical rod having a groove 255 therein, which is configured to receive a distal end 263 of the plunger 260. The groove 255 is configured to receive the distal end 263 of the plunger 260, which prevents the user 10 from extending their arm outward until the user's elbow extends upward to at least horizontal (e.g., even) with the user's shoulder. Upon raising ones elbow to at least shoulder height, the cords attached to the chest assembly 300, vest 310 or straps, causes the plunger 260 to release from the groove 255 within the hinge pin 252, which allows the lower arm support 220 to extend beyond 90 degrees in relationship to the upper arm support 230. Thus, by extending beyond 90 degrees the user 10 can extend their arm upward to release the basketball towards the net in a shooting motion. Once the shooter or user 10 has released the basketball, the hinge assembly 210 automatically resets without requiring any intervention on behalf of the shooter or user 10. In addition, once the plunger 260 locks into position, an audible click can be heard by the user, which acts as a means of reinforcing the habit of raising the elbow to the shoulder before releasing the ball.

FIGS. 7-11 are illustration of the hinge assembly 200 of the shooting apparatus 110 during use. As shown in FIGS. 7-11, a player's shooting motion is controlled with the shooting apparatus 110, wherein the hinge assembly 210 locks the lower arm support 220 and the upper arm support 230 relative to one another, if the users or players 10 forearm and upper arm obtain an approximately 90 degree angle to one another. Once the user or player 10 raises his elbow to approximately shoulder height, the hinge assembly 210 releases, which allows the lower arm support 220 and the upper arm support 230 to be moveable relative to one another.

Figure 7:
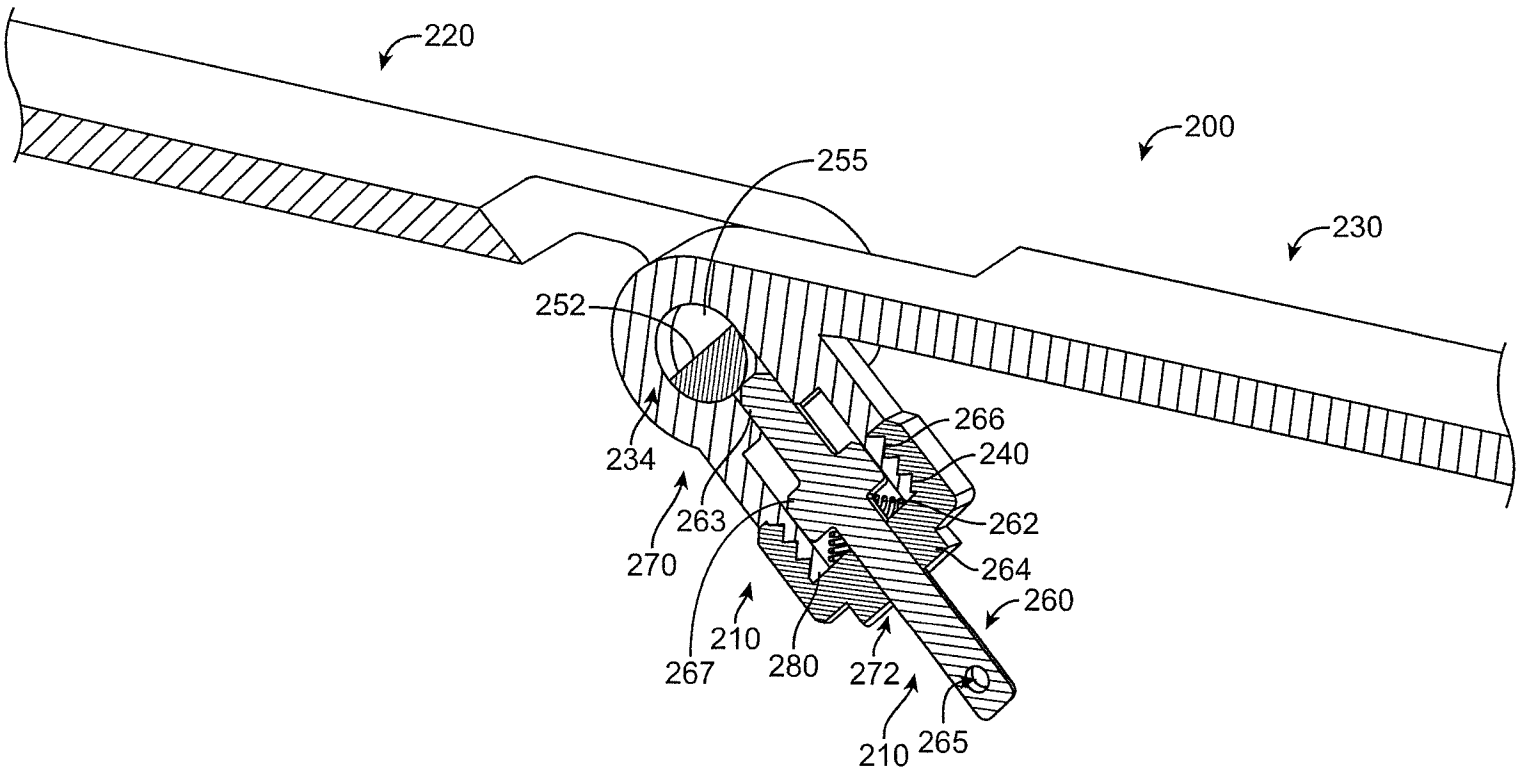
FIG. 7 is an illustration of a cross-sectional view of the mechanical assembly showing the arm in a straight position and the plunger is retracted.

FIG. 7 is an illustration of a cross-sectional view of the mechanical assembly 200 showing the lower arm support 220 and the upper arm support 230 in a horizontal plane or straight position, and wherein the plunger 260 is retracted. As shown in FIG. 7, the proximal end 232 of the upper arm support 230 includes a cylindrical bore 236 having a housing 238, which is at an angle to the upper arm support 230. The housing 238 has a thread end 240, which is configured to receive an internally threaded end cap 264. The end cap 264 has a central bore 272, which receives a proximal portion of the plunger 260. Upon placement of the end cap 264 on the threaded end 240 of the housing 238, the proximal portion of the plunger 260 extends outward through the central bore within the end cap 264. The end cap 264 forms an inner cavity 280, which receives the conical spring 262, the plunger 260 and extends through the cylindrical bore 236 so that the plunger 260 engages the hinge pin 252. The plunger 260 includes a cylindrical portion 267, which prevents the plunger 260 from sliding out of the inner cavity 280 upon engaging the end cap 264 on the threaded end 240 of the housing 238.

Figure 8:
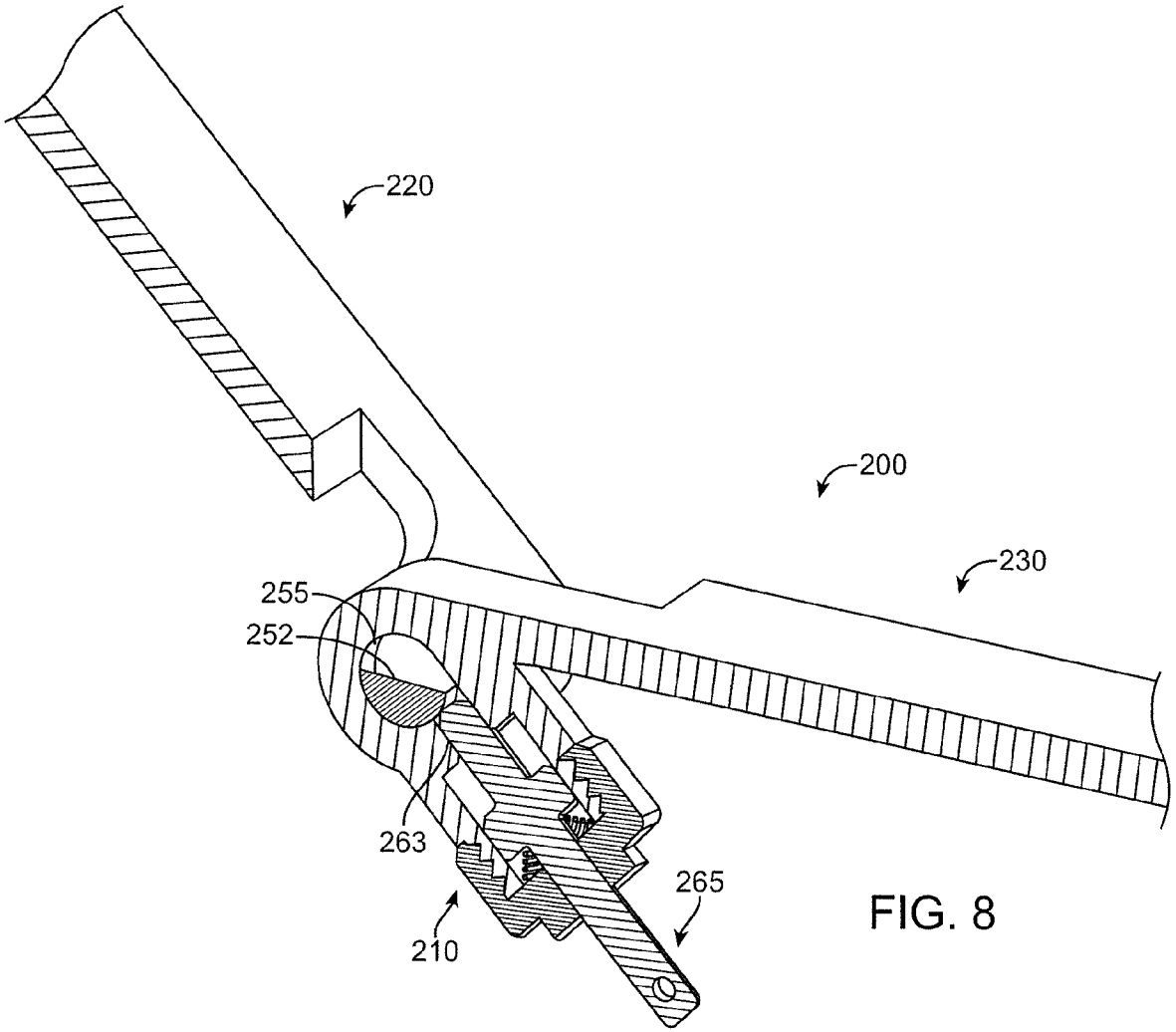
FIG. 8 is an illustration of a cross-sectional view of the mechanical assembly showing the arm at 45 degrees and the plunger is retracted.

FIG. 8 is an illustration of a cross-sectional view of the mechanical assembly 200 showing the lower arm support 230 bent at 45 degrees relative to the upper arm support 230 from a horizontal reference. As shown in FIG. 8, the plunger 260 is in retracted position, and wherein the distal end 263 of the plunger 260 is not engaged within the groove 255 of the hinge pin 252.

Figure 9:
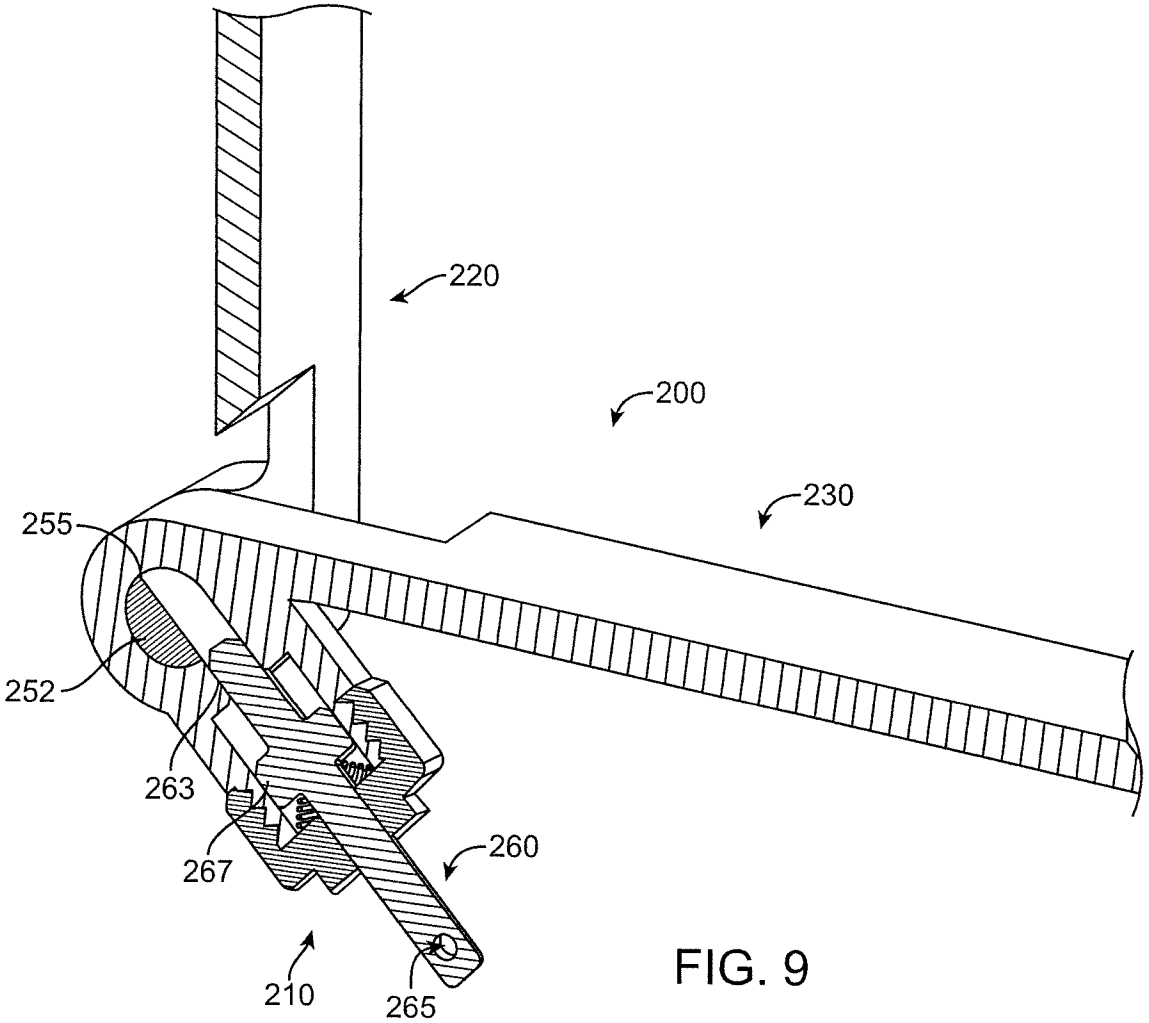
FIG. 9 is an illustration of a cross-sectional view of the mechanical assembly showing the arm bent at 90 degrees and the plunger is retracted.

FIG. 9 is an illustration of a cross-sectional view of the mechanical assembly showing the upper arm support 230 bent at 90 degrees to the lower arm support 220. As shown in FIG. 9, the plunger 260 is in a retracted position and is not engaged within the groove 255 of the hinge pin 252. However, as shown, as the upper arm support 230 rotates to 90 degrees the hinge pin 252 rotates such that the groove 255 is in alignment with the distal end 263 of the plunger 260.

Figure 10:
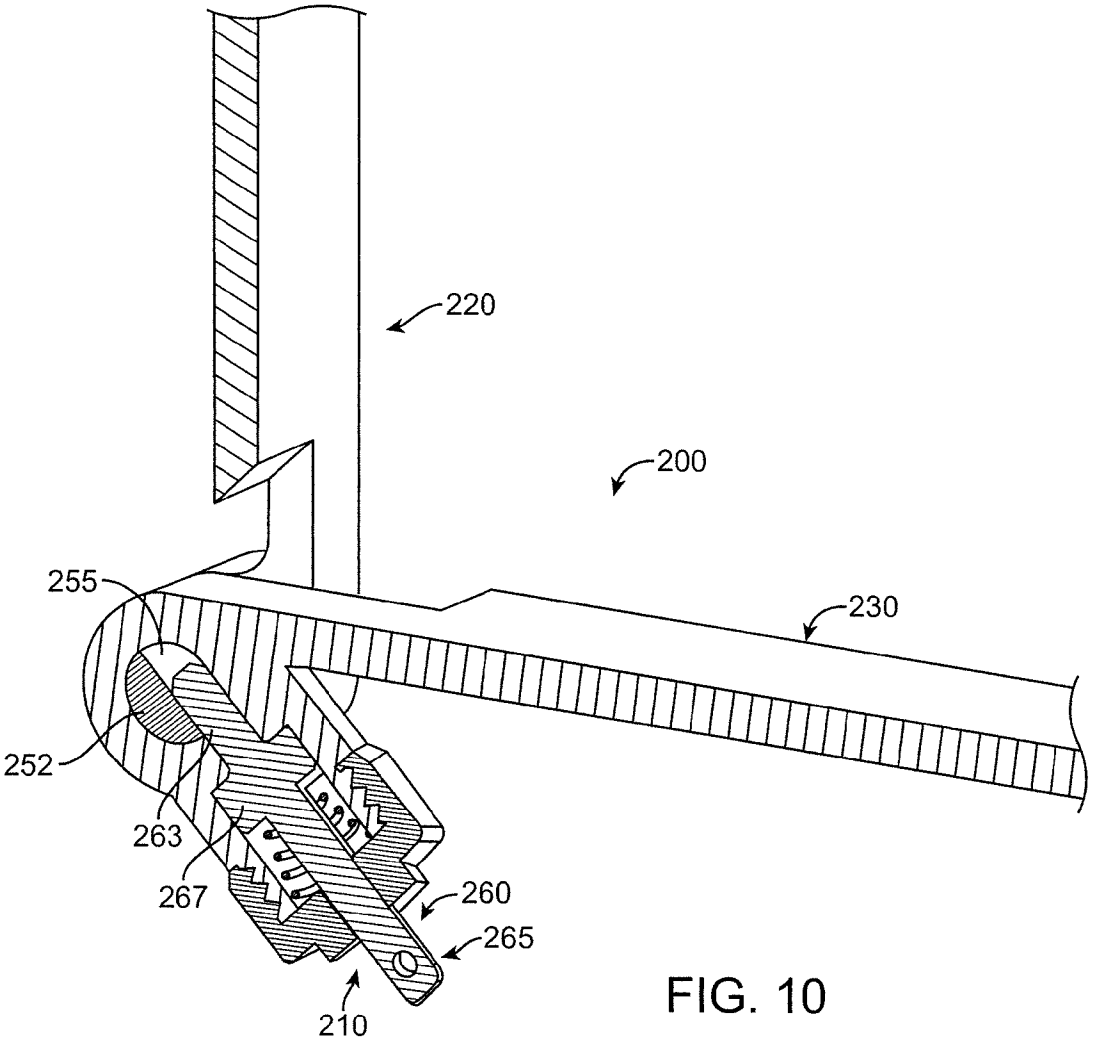
FIG. 10 is an illustration of a cross-sectional view of the mechanical assembly showing the arm bent at 90 degrees and the plunger is engaged.

FIG. 10 is an illustration of a cross-sectional view of the mechanical assembly 200 showing the upper arm support 230 bent at 90 degrees relative to the lower arm support 220 and the distal end 263 of the plunger 260 has moved forward into the groove 255 with the hinge pin 252. In accordance with an exemplary embodiment, the conical spring 262 presses against an outer edge of the cylindrical portion 267 of the plunger 260, which forces (moves forward) the distal end 263 of the plunger 260 to engage the groove 255 of the hinge pin 252.

Figure 11:
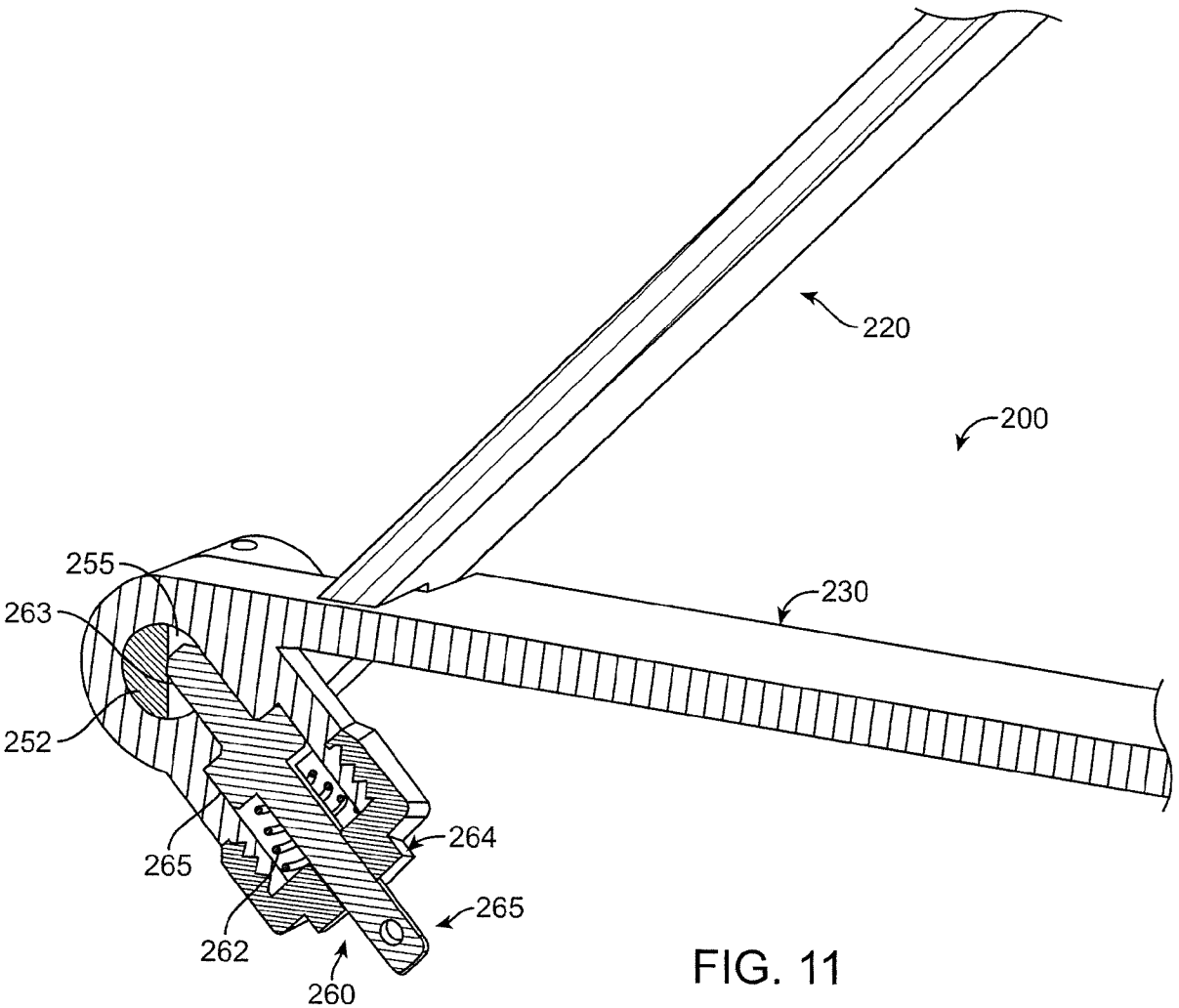
FIG. 11 is an illustration of a cross-sectional view of the mechanical assembly showing the arm bent at 135 degrees and the plunger is engaged.

FIG. 11 is an illustration of a cross-sectional view of the mechanical assembly 200 showing the upper arm support 230 bent at 135 degrees relative to the lower arm support 220. As shown in FIG. 11, the plunger 260 is engaged within the groove 255 of the hinge pin 252.

Figure 12:
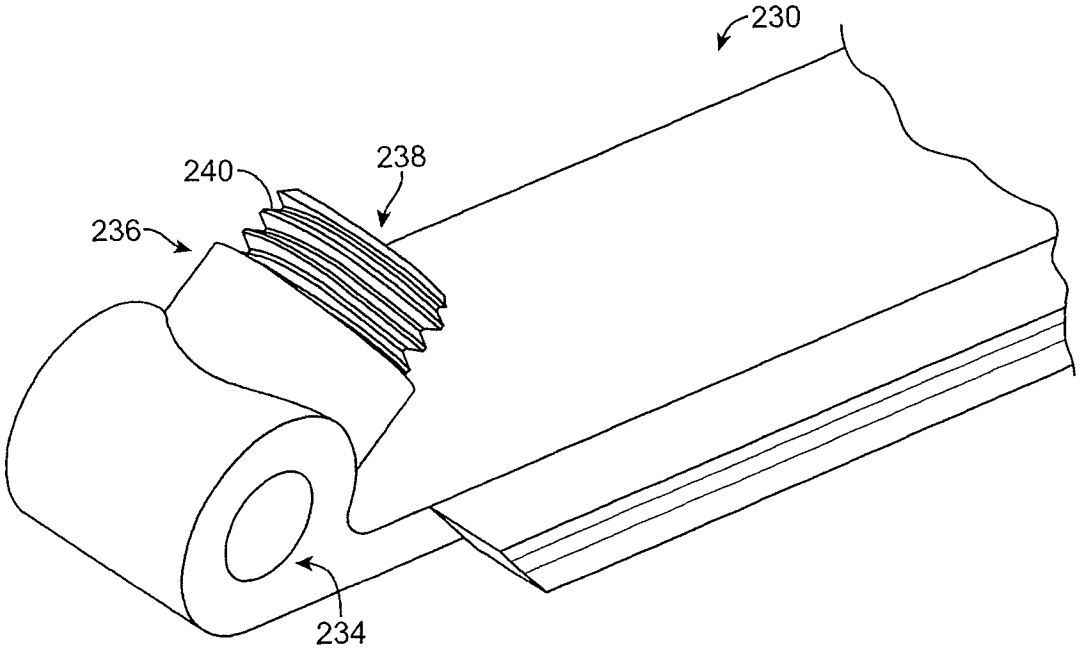
FIG. 12 is an illustration of a proximal portion of the upper arm support in accordance with an exemplary embodiment.

FIG. 12 is an illustration of a proximal portion of the upper arm support 230 in accordance with an embodiment. As shown in FIG. 12, the proximal end 232 of the upper arm support 230 includes a cylindrical bore 236 having a housing 238, which is at an angle to the upper arm support 230. The housing 238 has a thread end 240, which is configured to receive an internally threaded end cap 264.

Figure 13:
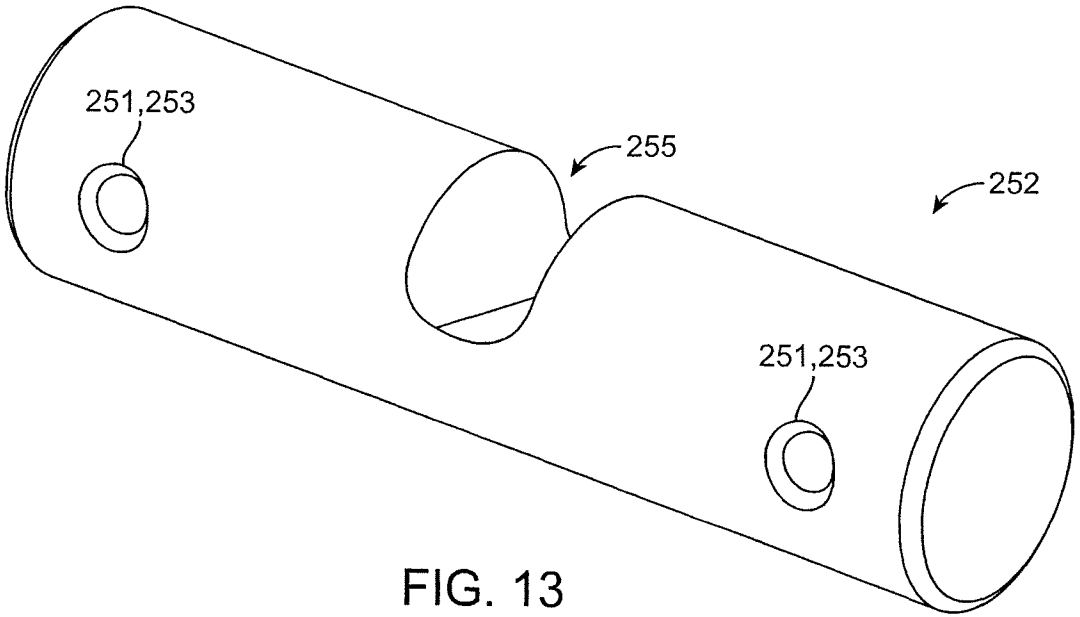
FIG. 13 is an illustration of a hinge pin in accordance with an exemplary embodiment.

FIG. 13 is an illustration of a hinge pin 252 in accordance with an embodiment. As shown in FIG. 13, the hinge pin 252 is cylindrical rod having a pair of bores 251, 253, each of which are configured to receive a set screw 254, 256 to secure the hinge pin 252 within hinge pin 252 is configured to fit within the horizontal bores 225, 227 within the proximal end 222 of the lower arm support 220 and the cylindrical bore 234 within the proximal end 232 of the upper arm support 230.

It will be apparent to those skilled in the art that various modifications and variation can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An assembly for increasing a basketball player's shooting accuracy, comprising:

a hinge assembly;

a lower arm support;

an upper arm support; and wherein the hinge assembly includes a plunger configured to extend outward from the hinge assembly, the plunger having a proximal end and a distal end, the proximal end including an opening configured to be attach to one or more cords and wherein upon raising of the basketball player's elbow to approximately the player's shoulder height, the plunger releases from a hinge pin within the hinge assembly to allow the lower arm support and the upper arm support to move relative to one another.

2. The assembly of claim 1, wherein the lower arm support and the upper arm support have a generally elongated shape.

3. The assembly of claim 1, wherein the hinge assembly is configured to receive a proximal end of the lower arm support and a proximal end of the upper arm support, which rotate from approximately an open horizontal position to a closed position.

4. The assembly of claim 1, comprising:

a means for securing the assembly to a forearm and upper arm of a user.

5. The assembly of claim 1, comprising:

an elastic sleeve for securing the assembly to a forearm and upper arm of a user.

6. The assembly of claim 1, wherein the one or more cords are one or more elastic cords, the one or more elastic cords are attached at one end to the plunger and at the other end to the basketball player.

* * * * *